US011925829B1

(12) United States Patent
Gonzalez

(10) Patent No.: US 11,925,829 B1
(45) Date of Patent: Mar. 12, 2024

(54) ADJUSTABLE EXERCISE BENCH

(71) Applicant: HABLAMER, LLC, Green Cove Springs, FL (US)

(72) Inventor: Carlos E. Gonzalez, Norwalk, CA (US)

(73) Assignee: Hablamer, LLC, Carson City, NV (US)

( * ) Notice: Subject to any disclaimer, the term of this patent is extended or adjusted under 35 U.S.C. 154(b) by 175 days.

(21) Appl. No.: 17/405,897

(22) Filed: Aug. 18, 2021

Related U.S. Application Data

(60) Provisional application No. 63/068,140, filed on Aug. 20, 2020.

(51) Int. Cl.
*A63B 21/00* (2006.01)

(52) U.S. Cl.
CPC .. *A63B 21/4029* (2015.10); *A63B 2208/0228* (2013.01); *A63B 2208/0252* (2013.01); *A63B 2225/09* (2013.01)

(58) Field of Classification Search
CPC . A63B 21/4047; A63B 21/045; A63B 21/026; A63B 21/4031; A63B 23/0355; A63B 21/0455; A63B 2225/09; A63B 21/0628; A63B 23/1281; A63B 21/055; A63B 23/0494; A63B 23/0211; A63B 21/4029; A63B 2208/0228; A63B 2208/0252
See application file for complete search history.

(56) References Cited

U.S. PATENT DOCUMENTS

| | | | | |
|---|---|---|---|---|
| 3,709,487 | A * | 1/1973 | Walker | A63B 21/04 297/118 |
| 4,582,319 | A * | 4/1986 | Luna | A63B 21/4031 482/130 |
| 4,653,751 | A | 3/1987 | Green | |
| 5,125,884 | A | 6/1992 | Weber et al. | |
| 5,725,460 | A | 3/1998 | Marsh | |
| 5,906,566 | A * | 5/1999 | Whitcomb | A63B 21/0552 482/133 |
| 6,000,758 | A | 12/1999 | Schaffner et al. | |
| 6,287,243 | B1 | 9/2001 | Isom et al. | |
| 6,371,896 | B1 * | 4/2002 | Kettler | A63B 21/4029 297/14 |
| 6,659,923 | B2 | 12/2003 | Teuscher | |
| 6,685,601 | B1 | 2/2004 | Knapp | |
| 6,966,872 | B2 | 11/2005 | Eschenbach | |
| 7,537,552 | B2 | 5/2009 | Dalebout et al. | |
| 7,563,209 | B2 * | 7/2009 | Webber | A63B 23/0494 482/137 |
| 7,722,513 | B2 | 5/2010 | Habing | |
| 7,815,552 | B2 * | 10/2010 | Dibble | A63B 21/154 482/92 |

(Continued)

*Primary Examiner* — Andrew S Lo
*Assistant Examiner* — Andrew M Kobylarz
(74) *Attorney, Agent, or Firm* — Aikin & Gallant, LLP

(57) ABSTRACT

An adjustable exercise bench comprising: a back support coupled to a seat support, the back support is adjustable between a generally horizontal position and an inclined position, the back support having a first support portion and a second support portion, wherein the first support portion and the second support portion are adjustable together, or the second support portion is separately adjustable from the first support portion, between the generally horizontal position and the inclined position.

26 Claims, 12 Drawing Sheets

(56) References Cited

U.S. PATENT DOCUMENTS

| | | | | |
|---|---|---|---|---|
| 7,892,155 | B2 * | 2/2011 | Pearson | A63B 21/4047 482/121 |
| 9,446,849 | B1 * | 9/2016 | Pinkal | B60N 2/3015 |
| 10,576,352 | B2 * | 3/2020 | Vester | A63B 21/4029 |
| 2003/0050157 | A1 | 3/2003 | Teuscher | |
| 2004/0067829 | A1 | 4/2004 | Eschenbach | |
| 2005/0049121 | A1 | 3/2005 | Dalebout et al. | |
| 2007/0270292 | A1 * | 11/2007 | Laney | A63B 22/0605 482/121 |

* cited by examiner

ADJUSTABLE EXERCISE BENCH

CROSS-REFERENCE TO RELATED APPLICATIONS

This application claims the priority to U.S. Application No. 63/068,140 filed Aug. 20, 2020, which is incorporated herein in its entirety.

FIELD

The present invention relates to an adjustable exercise bench, more specifically an exercise bench including a back support with upper and lower portions adjustable between different positions. Other aspects are also described and claimed.

BACKGROUND

Traditional adjustable exercise benches have one long, rigid, back support that adjusts as a single unit between flat and inclined positions. The highest inclined position is generally used for shoulder press exercises. However, doing shoulder press exercises with a long back support that extends against the user's shoulders can be restrictive on the shoulders.

SUMMARY

An aspect of the disclosure is directed to a back support for an adjustable exercise bench that includes two sections, a lower back support and an upper back support. The two supports can be adjusted together to support the lower back and shoulders, or the lower back support can be adjusted by itself to provide a lower support that does not restrict the shoulders during a shoulder press exercise.

Representatively, in one aspect of the disclosure, a bench for exercising has a back support portion that is adjustable for flat or horizontal, incline and decline positions; a seat portion that is adjustable from flat to inclined positions; an optional attachment receiver for leg extension apparatus, dip apparatus, preacher curl apparatus and other options. In addition, the back support portion may include an upper support portion and a lower support portion that can be separately adjusted. The upper support portion, the lower support portion and the seat portion may include an upper back pad, a lower back pad and a seat pad, respectively.

The bench may further include one or more lock and release mechanisms for adjustment of the overall back support portion, the lower back pad, and/or the seat support portion. The lock and release mechanism for the overall back support portion can be activated by a hand or a foot of the user. The bench may further include wheels on the base to allow rolling mobility of the bench.

The upper and lower back support portions are adjustable together to provide flat, decline and incline positions. The lower back portion is also independently adjustable from the upper back portion to provide a low back support for leg extension, shoulder presses, overhead tricep extensions, bicep curls, or other dumbbell and functional exercises. The lower back support can adjust to various angles.

Using just the lower back support portion for shoulder presses, bicep curls, and overhead tricep extensions gives the user more shoulder freedom since the shoulders are not against the back pad.

In some aspects, the upper and lower back support portions may be used together for flat, decline and incline exercises.

The bench may be adjustable between flat, decline and incline positions by sliding the seat base back and forth on the main base. An articulation link connected to the base and the main back pad support may be used to position the seat and back pads for flat, decline and different incline positions based on where the seat base is positioned along the main base.

This sliding of the seat base back and forth along the main base keeps the position of the bench pressing location for chest/incline/shoulder presses under the press bar position of a smith machine without moving the bench base in relation to the floor.

Maintaining the pressing position location under the press bar when adjusting from flat, decline or inclined presses, however, does not allow a back support for leg extension exercises from the front of the bench. The adjustable bench disclosed herein solves this issue by providing the separately adjustable lower and upper back support portions. In particular, the lower back support portion can be adjusted up to various angles, without the upper back portion, to support the lower back during leg extension exercises. The upper and lower support portions may be, or may further include, support pads or cushions for user comfort.

Representatively, in one aspect the invention may include an adjustable exercise bench comprising: a back support coupled to a seat support, the back support is adjustable between a generally horizontal position and an inclined position or declined position, the back support having a first support portion and a second support portion, wherein the first support portion and the second support portion are adjustable together, or the second support portion is separately adjustable from the first support portion, between the generally horizontal position and the inclined position. The adjustable exercise bench may further include a first support portion pad coupled to the first support portion and a second support portion pad coupled to the second support portion. In some aspects, the inclined position is a first inclined position, and the bench further comprises a second inclined position. In addition, the seat support may be adjustable from the generally horizontal position to an inclined position. A base frame to support the back support and the seat support may further be included. The adjustable exercise bench may further include a sliding carriage coupled to the base frame, the sliding carriage configured to adjust and lock to various positions along the base frame and hold the back support and seat support to the base frame. Additional aspects may include an articulation link coupled between the base frame and the back support to adjust the back support between the generally horizontal position and the inclined position relative to the floor, and wherein the articulation link is proximate the back support when adjusting the sliding carriage along the base frame. The articulation link may be pivotally secured between the base frame and the back support. In some aspects, a front end of the base frame is configured to be coupled to an exercise accessory. In still further aspects, the second support portion is a lower back support portion and the lower back support portion is dimensioned to support only a lower back of the user such that using only the lower back support portion for seated exercises provides freedom of movement of the user's shoulders by keeping the shoulders free from restriction. The bench may further include a locking mechanism that is operable to lock the sliding carriage at various positions along the base frame, and the locking mechanism is operable to be activated by a hand or a foot of the user. The seat support may be adjustable from a generally horizontal position to an inclined position.

In another aspect, an adjustable exercise bench includes a base frame; a carriage adjustable along the base frame; a locking mechanism operable to lock the carriage at various positions along the base frame; a back support and seat support coupled to the carriage, wherein the back support is adjustable between a generally flat position, a declined position and an inclined position, and wherein the back support comprises an upper support portion and a lower support portion, and the lower support portion is operable to be adjusted together with, or separately from, the upper support portion between the generally flat position and inclined positions. The carriage may be slidably adjustable along the base frame and locks to various positions along the base frame and holds the back support and seat support to the base frame. The bench may further include an articulation link secured between the base frame and the back support to adjust the back support from the generally flat position to the inclined or declined position relative to the floor, and the articulation link is proximate the back support when adjusting the carriage along the base frame. The articulation link may be pivotally secured between the base frame and the back support. In some aspects, a front end of the base frame is configured to attach to an exercise accessory. In some aspects, the lower support portion is dimensioned to contact only a lower back of a user such that for seated exercises the lower support portion provides freedom of movement of the shoulders by keeping the shoulder blades free from restriction. The locking mechanism may be operable to be released by a hand or a foot of a user. In some aspects, the seat support is adjustable from a relatively flat position to an inclined or declined position.

In another aspect, the invention may include an adjustable exercise bench including a back support, a seat support and a receiver for attaching optional exercise stations, the back support comprising a lower back support and an upper back support, wherein the lower back support and the upper back support are operable to be inclined together to form an elongated back support, and the lower back support is operable to be inclined separate from the upper back support to form a shortened back support, and wherein when the lower back support is inclined separate from the upper back support, the lower back support supports the lower back of a user without supporting the shoulders to provide freedom of movement of the shoulders. The seat support may be operable to adjust from a generally flat position to an inclined position. In some aspects, a base frame supports the back support, the seat support, and the receiver. In some cases, the receiver is proximate to a front end of the base frame. The invention may further include a sliding carriage that is operable to be adjusted and locked at various positions along the base frame and hold the back support and seat support to the base frame. Adjustment of the carriage from a front end of the base frame toward a rear end of the base frame inclines the hack support. A locking mechanism operable to lock the carriage at various positions along the base frame and to be activated by a hand or a foot of a user, may further be provided.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect in this disclosure are not necessarily to the same aspect, and they mean at least one.

DETAILED DESCRIPTION

In this section we shall explain several preferred aspects of this invention with reference to the appended drawings. Whenever the shapes, relative positions and other aspects of the parts described in the aspects are not clearly defined, the scope of the invention is not limited only to the parts shown, which are meant merely for the purpose of illustration. Also, while numerous details are set forth, it is understood that some aspects of the invention may be practiced without these details. In other instances, well-known structures and techniques have not been shown in detail so as not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
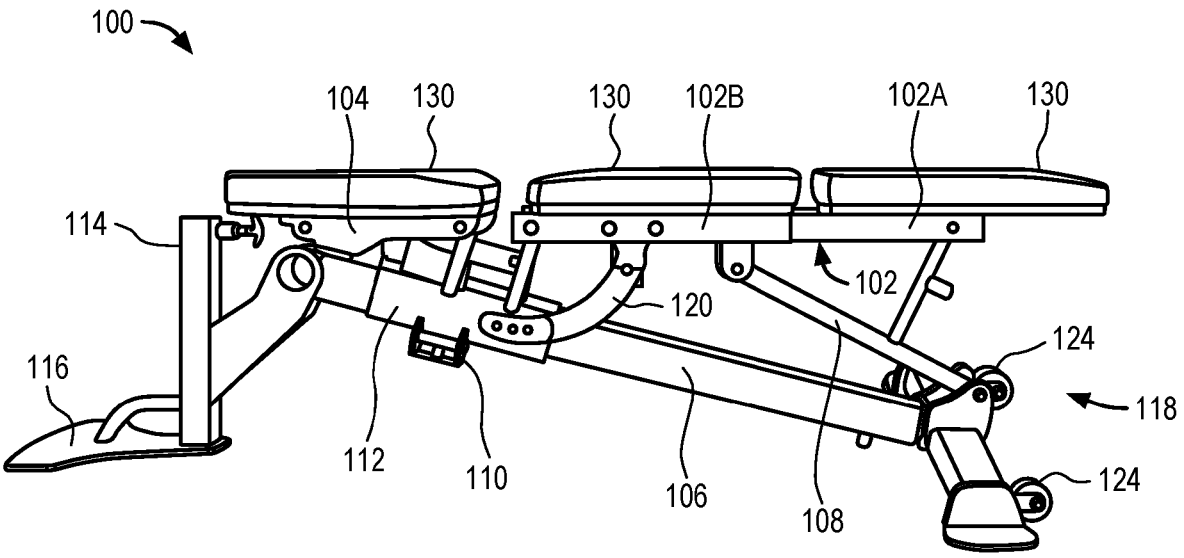
FIG. 1 illustrates a side view of one embodiment of an adjustable back support for an exercise bench.

FIG. 1 illustrates one embodiment of an adjustable back support for an exercise bench. The adjustable back support 100 includes a back support portion 102, a seat support portion 104 and a base frame 106 that supports the back support portion 102 and the seat support portion 104. The back support portion 102 includes a first or upper support portion 102A and a second or lower support portion 102B. Each of the upper portion 102A, lower support portion 102B and seat support portions 104 may include pads 130.

Figure 3:
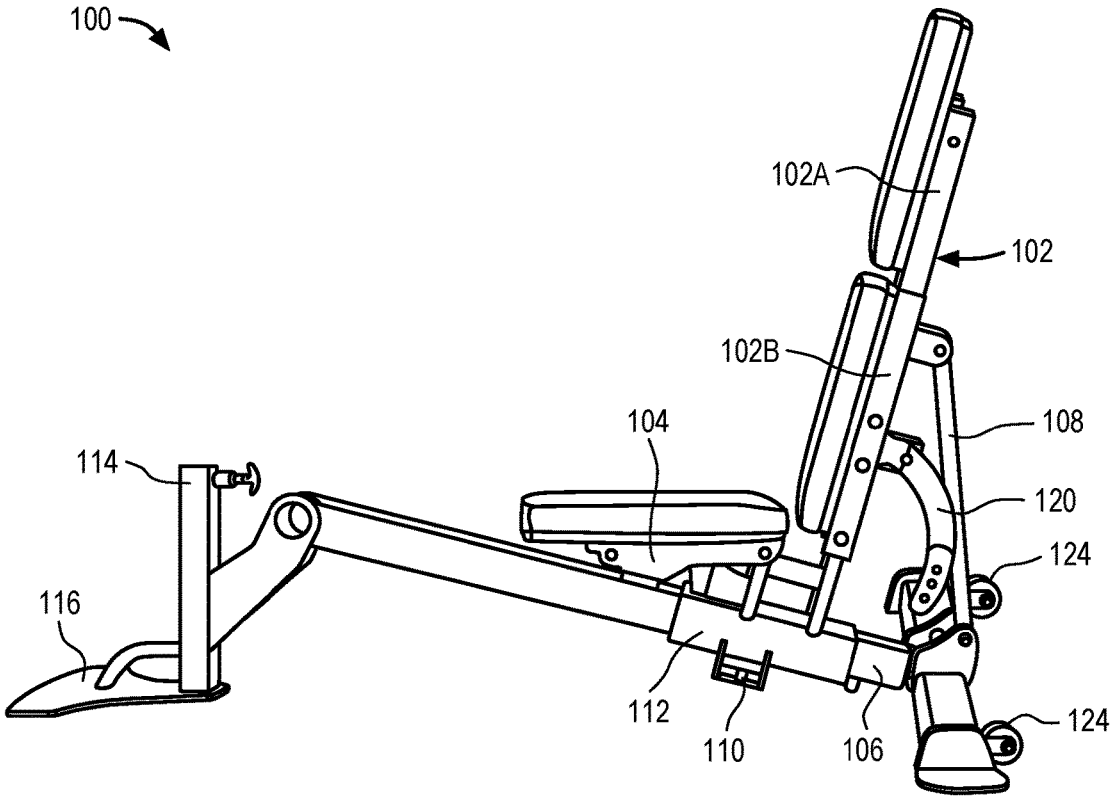
FIG. 3 illustrates a side view of the adjustable back support of FIG. 1 according to another embodiment.

The back support portion 102, including the upper support portion 102A and/or the lower support portion 102B, may be adjustable between a flat or horizontal, incline and decline positions. Representatively, in some aspects, the upper support portion 102A and lower support portion 102B are adjustable together between a flat (or horizontal) position as shown in FIG. 1, one or more incline positions as shown in FIG. 3, and/or a decline position. When adjusted together, the lower back support portion 102B is dimensioned to support the lower back of the user and the upper back support portion 102A is dimensioned to support the upper back of the user. In other words, the combination of the upper and lower support portions 102A, 102B provides an elongated back support portion that supports the entire back of the user. The upper and lower back support portions 102A, 102B used together are suitable for flat, decline and incline exercises, similar to traditional flat, decline, incline benches.

Figure 8A:
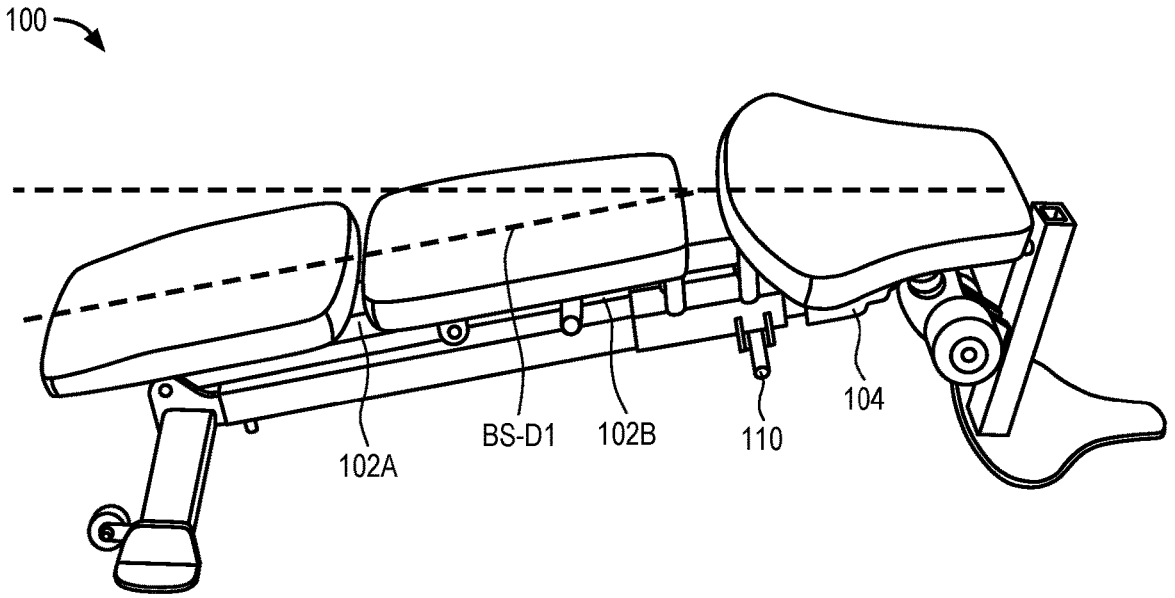
FIGS. 8A-8D illustrate perspective side views of the adjustable back support of FIG. 1 according to another embodiment.
Figure 8B:
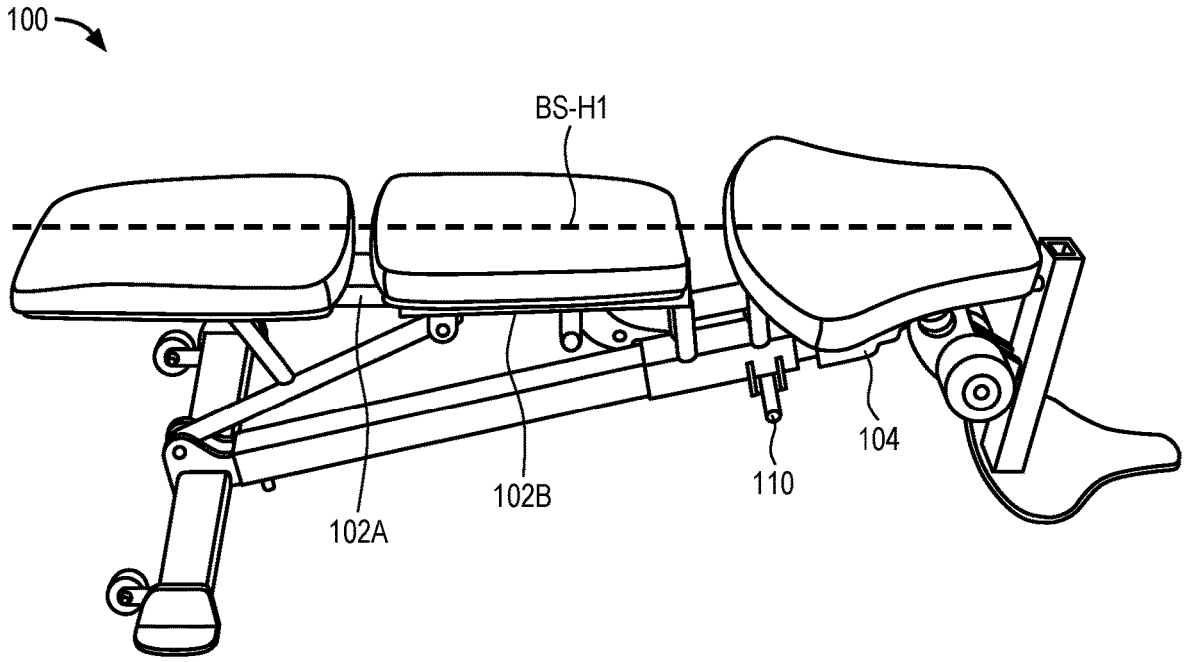
Figure 8C:
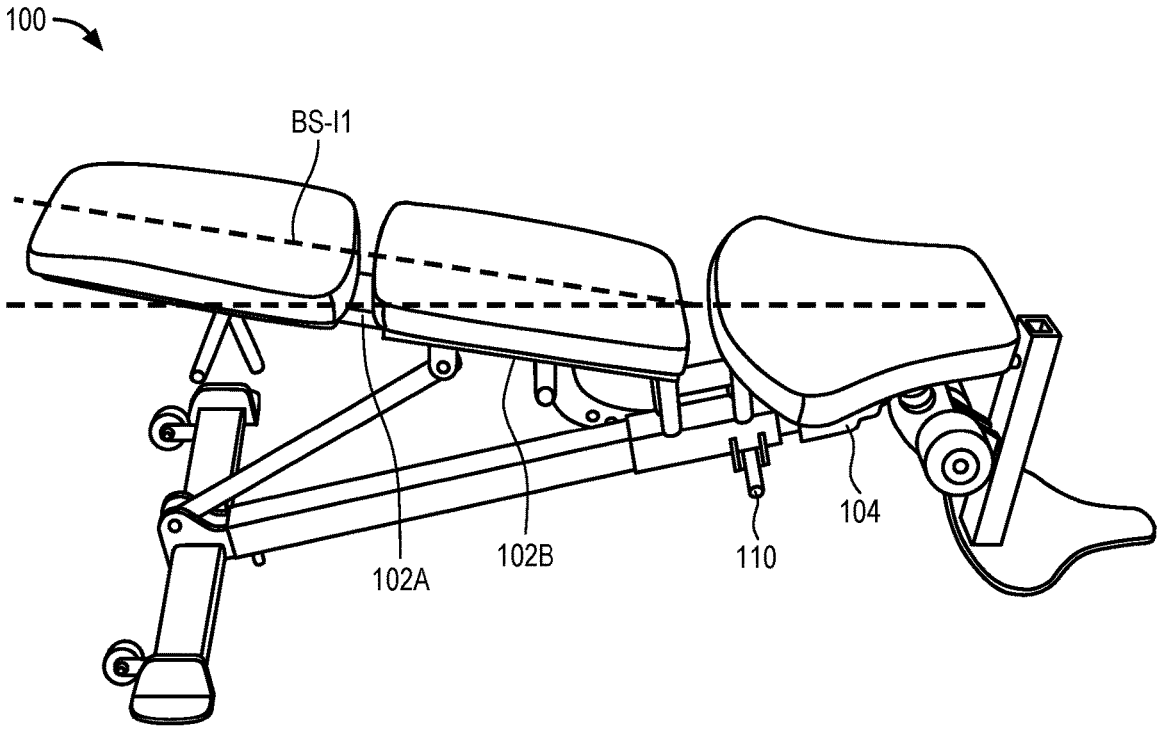
Figure 8D:
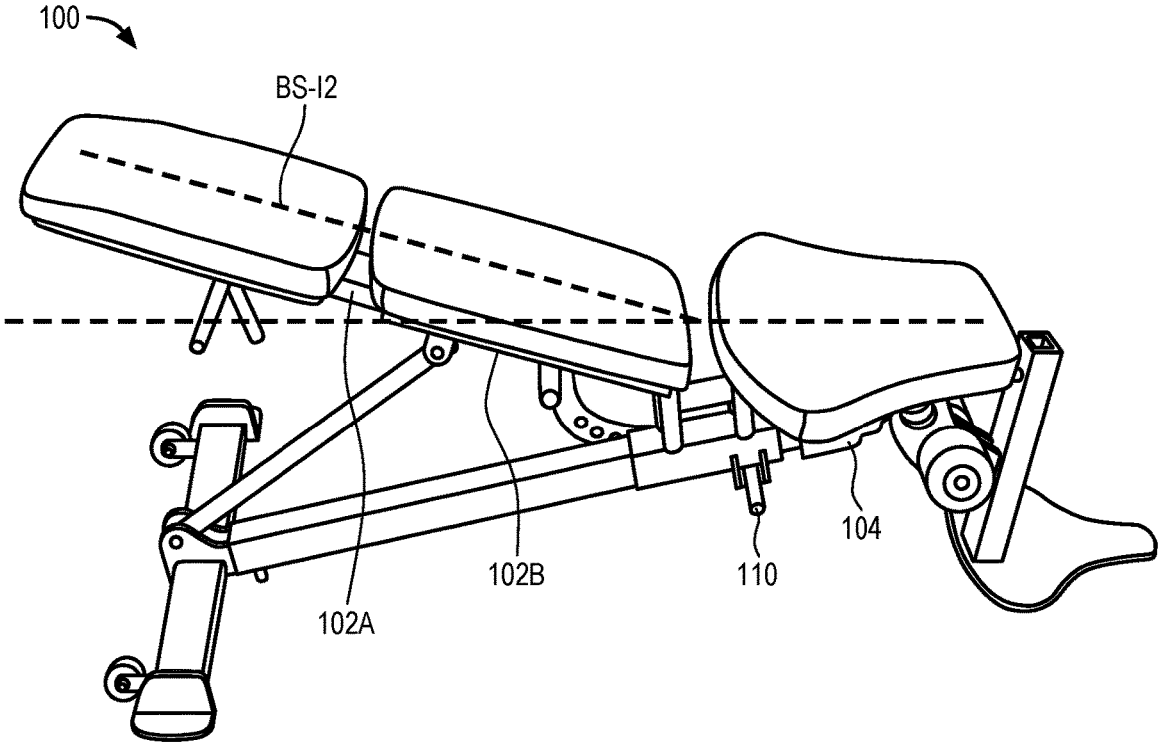

Representatively, FIGS. 8A-8D further illustrate the different incline/decline angles to which the back support portion 102 (including portions 102A-B) may be adjusted to. For example, FIG. 8A shows the back support portion 102 adjusted to a declined position as shown by the back support decline angle (BS-D1). FIG. 8B shows the back support portion 102 in a relatively flat or horizontal position as shown by the horizontal angle (BS-H1) (e.g., substantially aligned with, or in a same plane as, the seat portion 104). FIG. 8C then shows the back support portion 102 adjusted to a first inclined position as shown by the first inclined angle (BS-I1). FIG. 8D shows the back support portion 102 adjusted to a second inclined position as shown by the second inclined angle (BS-I2), which is different than the first inclined angle (BS-I1). Although three representative angles/positions are shown, it should be understood that back support portion 102 may be adjusted to any number of positions/angles between the horizontal position and the illustrated inclined positions/angles. For example, in some aspects, the inclined position of the back support portion 102 may be at any angle within a range of anywhere from about zero degrees (e.g., a horizontal position) to about 90 degrees relative to horizontal, for example from zero degrees to an angle of about 10 degrees, 20 degrees, 30 degrees, 40 degrees, 50 degrees, 60 degrees, 70 degrees, 80 degrees or about 90 degrees, when measured in a clockwise direction.

Figure 7A:
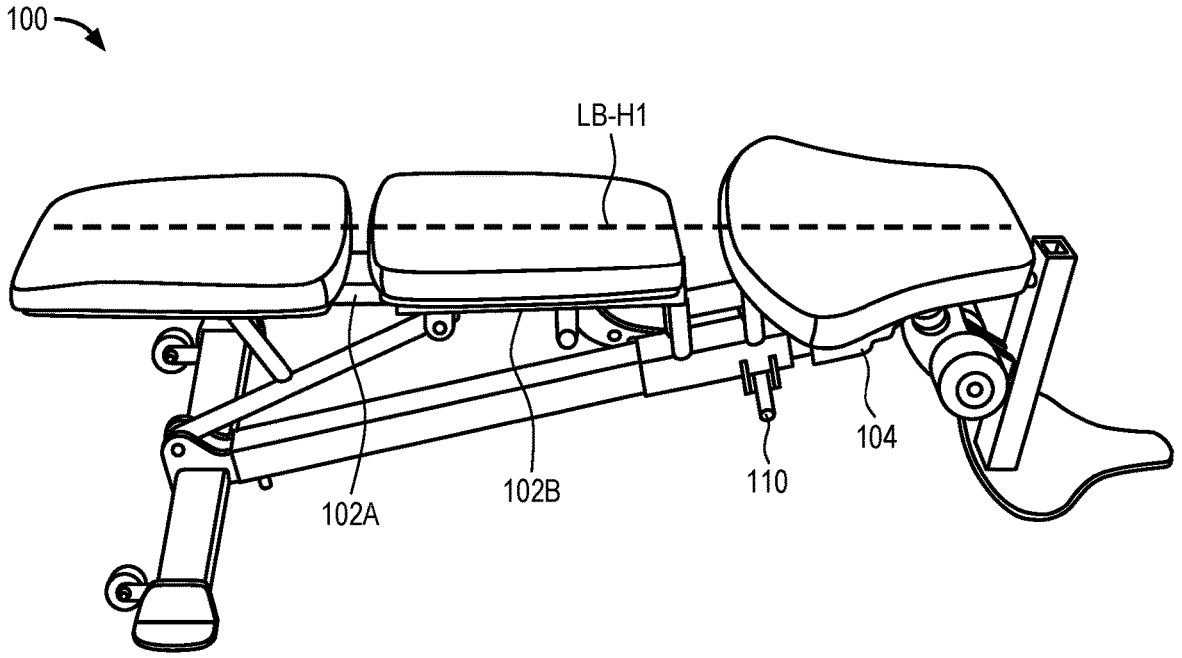
FIGS. 7A-7E illustrate perspective side views of the adjustable back support of FIG. 1 according to another embodiment.
Figure 7B:
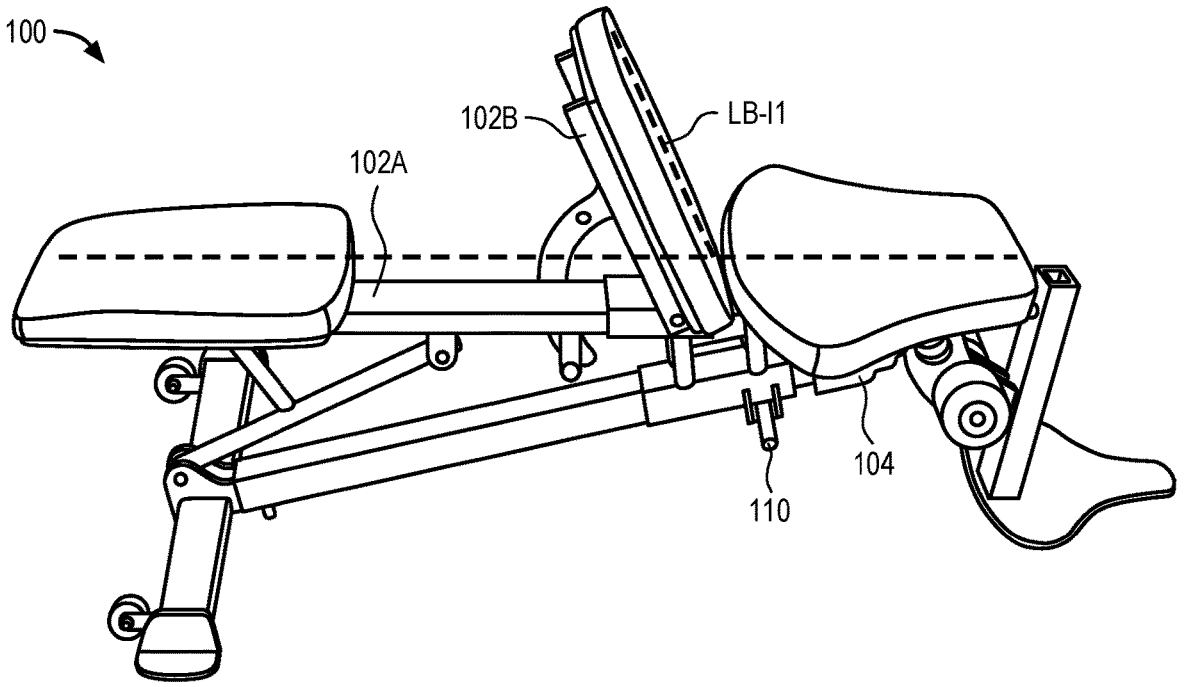
Figure 7C:
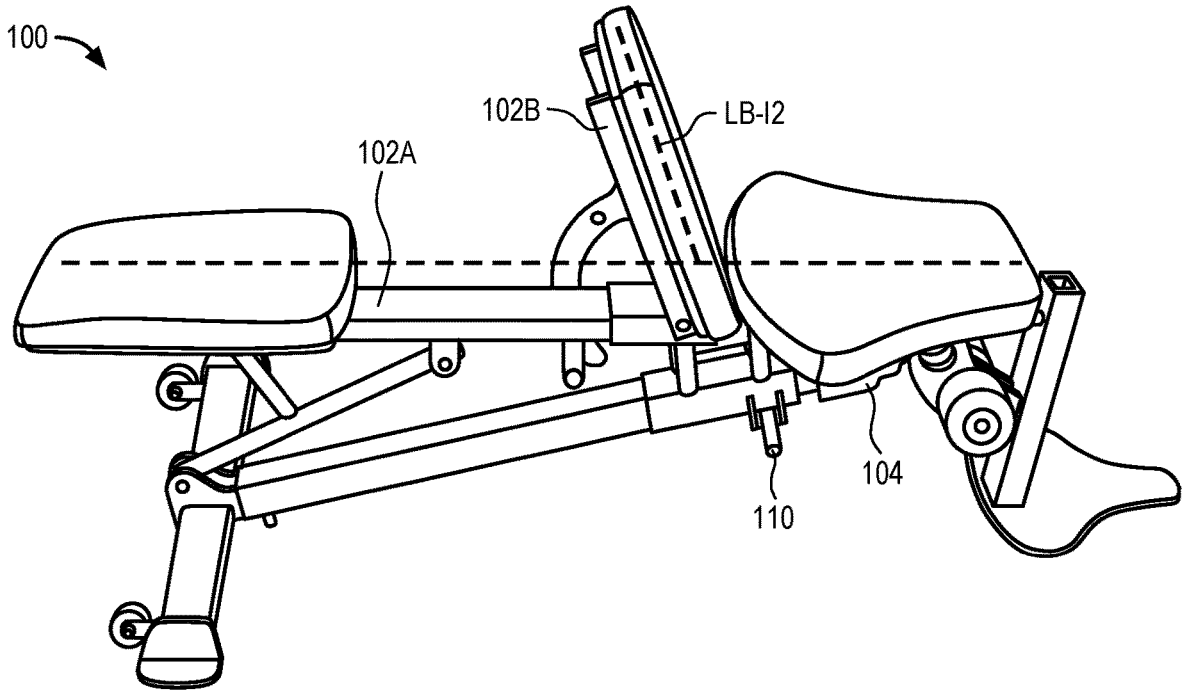
Figure 7D:
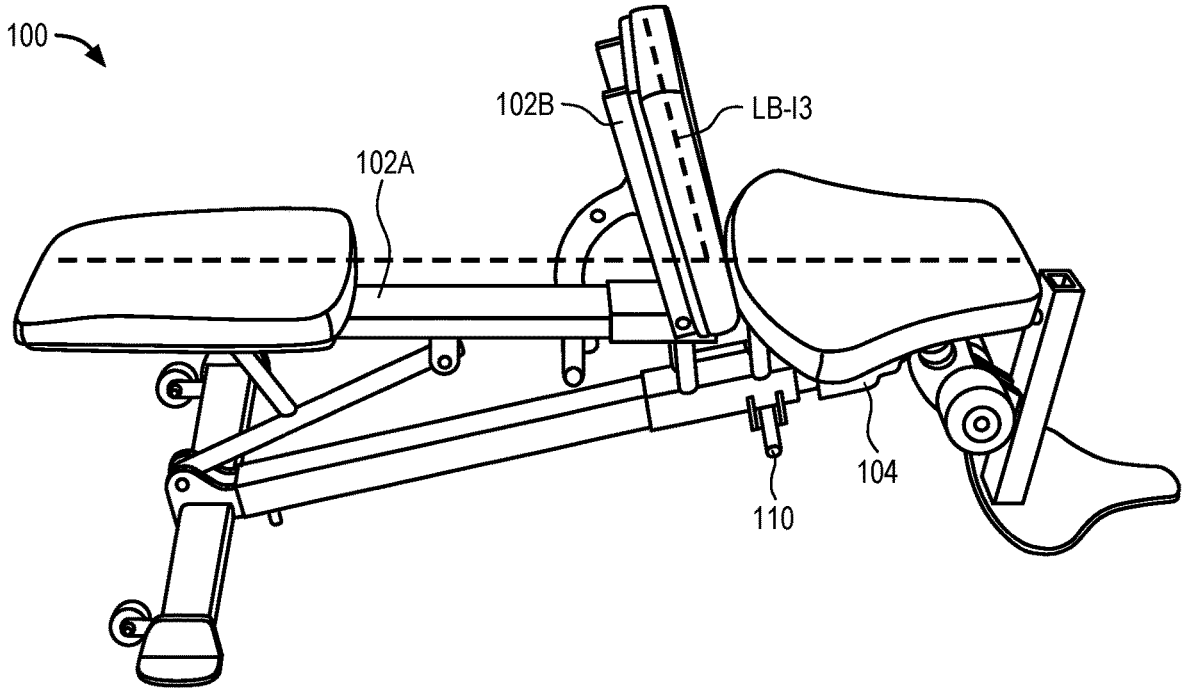
Figure 7E:
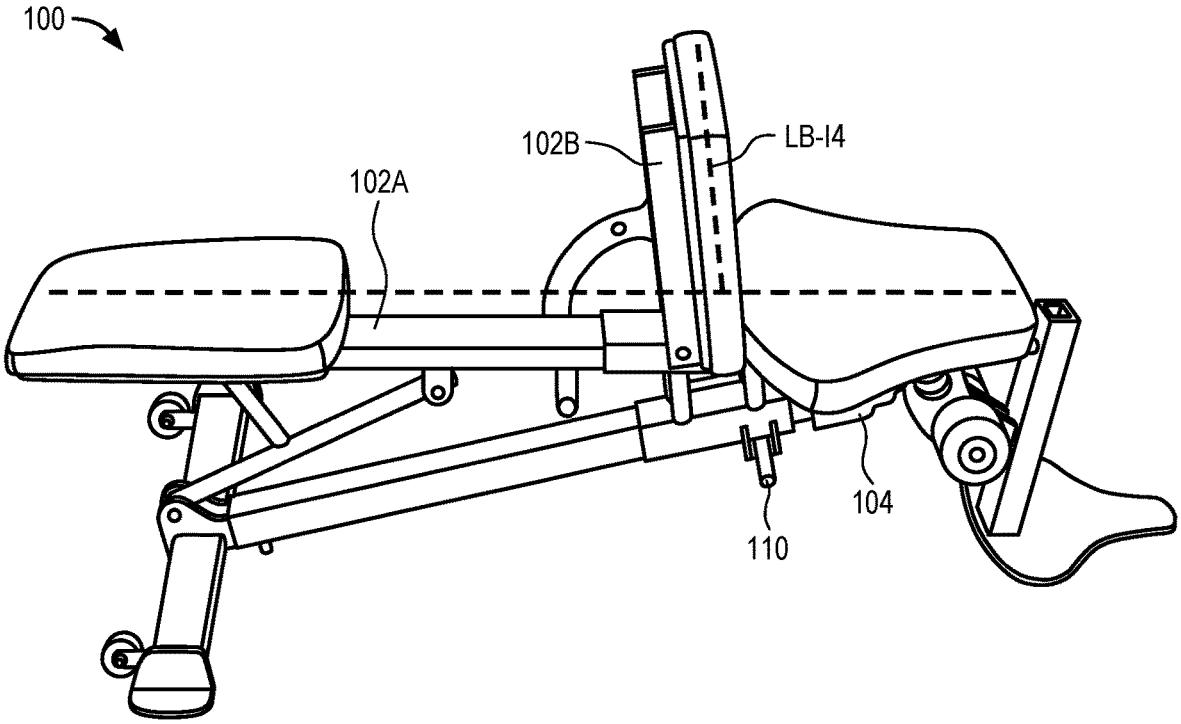

In still further embodiments, the lower back support portion 102B is also independently (or separately) adjustable from the upper back support portion 102A, between the flat and incline positions as show in FIG. 2, FIG. 4 and FIGS. 7A-7E. As previously discussed, the lower back support portion 102B is dimensioned to support only the lower back and does not extend up to the user's shoulders when the user is seated on the seat support portion 104. For example, lower back support portion 102B may have a height (or length) which is less than that of a user's entire back, or for example, equivalent to that of the midsection of a user's torso. Accordingly, adjusting only the lower back support portion 102B provides a low back support for leg extension, shoulder presses, overhead tricep extensions, bicep curls, or other dumbbell and functional exercises. The lower back support portion 102B can adjust to a number of different incline positions depending on the desired use. Representative inclination angles to which the lower back support portion 102B alone may be adjusted to are illustrated in FIGS. 7A-7E. In particular, FIG. 7A shows upper back support portion 102A, lower back support portion 102B, and seat portion 104 all initially in a generally flat or horizontal position or angle (LB-H1). FIGS. 7B-7E show the adjustment of only the lower back support portion 102B to a number of different inclination angles while the upper back support portion 102A and seat portion 104 remain in the relatively flat, horizontal position or declined position. Representatively, FIG. 7B shows the lower back support portion 102B in a first inclined position represented by the inclined angle (LB-I1), FIG. 7C shows lower back support portion 102B in a second inclined position represented by the inclined angle (LB-I2), FIG. 7D shows lower back support portion 102B in a third inclined positions represented by the inclined angle (LB-I3) and FIG. 7E shows lower back support portion 102B in a fourth inclined position represented by the inclined angle (LB-I4). As can be understood from the representative inclined angles LB-I1 to LB-I4, each of the inclined positions are different with the first position represented by angle LB-I1 being closest to horizontal (e.g., angle LB-H1) and the fourth position represented by angle LB-I4 being closest to vertical. Although a number of representative angles/positions are shown, it should be understood that lower back support portion 102B may be adjusted to any number of positions/angles between the horizontal position and the illustrated inclined positions/angles. For example, in some aspects, the inclined position that lower back support 102B may be adjusted to may be at an angle within a range of anywhere from about zero degrees (e.g., horizontal) to about 90 degrees, for example, from zero degrees to an angle of about 10 degrees, 20 degrees, 30 degrees, 40 degrees, 50 degrees, 60 degrees, 70 degrees, 80 degrees or about degrees, relative to horizontal. It should further be understood that in some aspects, some of the inclined positions or angles of the lower back support portion 102B (e.g., inclined angles LB-I1 to LB-I4) may be different than the inclined positions or angles that the lower and upper back supports 102A-B are adjusted to together (e.g., BS-I1 to BS-I2), although in some aspects one or more of the positions/angles may be the same. For example, in some aspects, at least one or more of the inclined positioned represented by angles BS-I1, BS-I2 of the back support 102 may be closer to horizontal than at least one of the inclined positions represented by angles LB-I1 to LB-I4 of the lower back support 102B when adjusted separately. The back support 102 having upper and lower back support portions 102A-B may, however, be considered adjustable as a single member or as separate portions, between the generally horizontal position and an inclined position (which could include any one or more of the positions represented by angles BS-I1, BS-I2, LB-I1 to LB-I4).

Figure 9A:
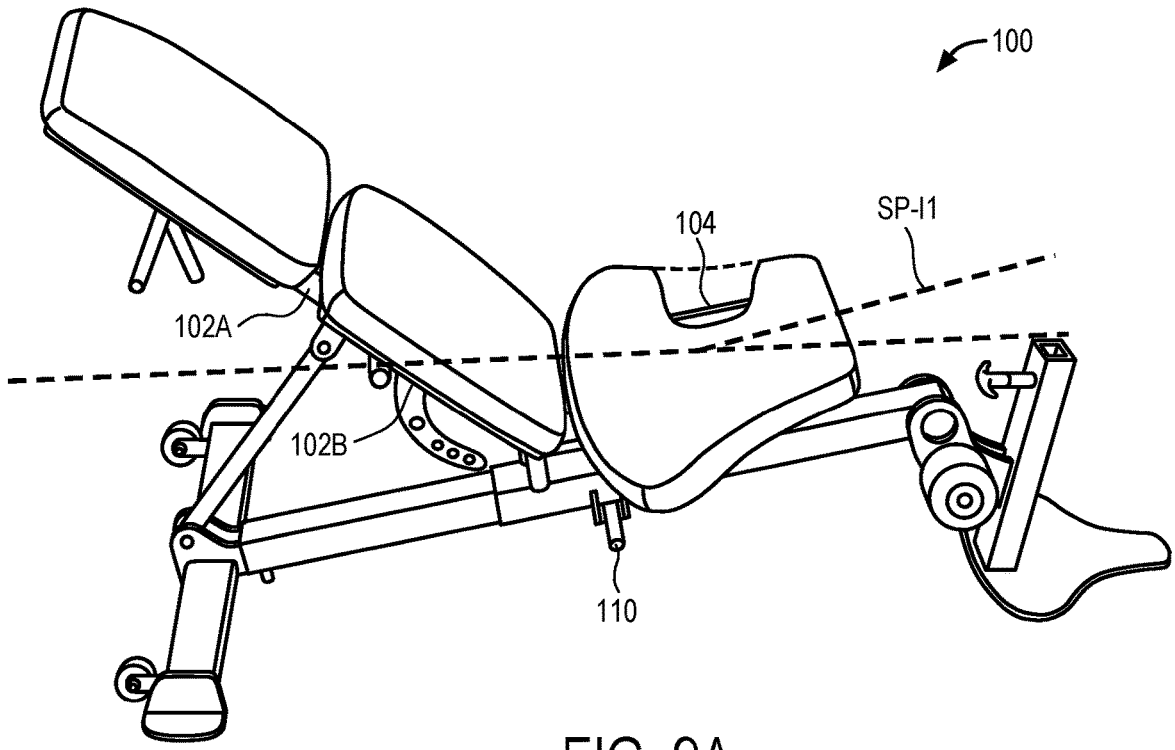
FIGS. 9A-9B illustrate perspective side views of the adjustable back support of FIG. 1 according to another embodiment.
Figure 9B:
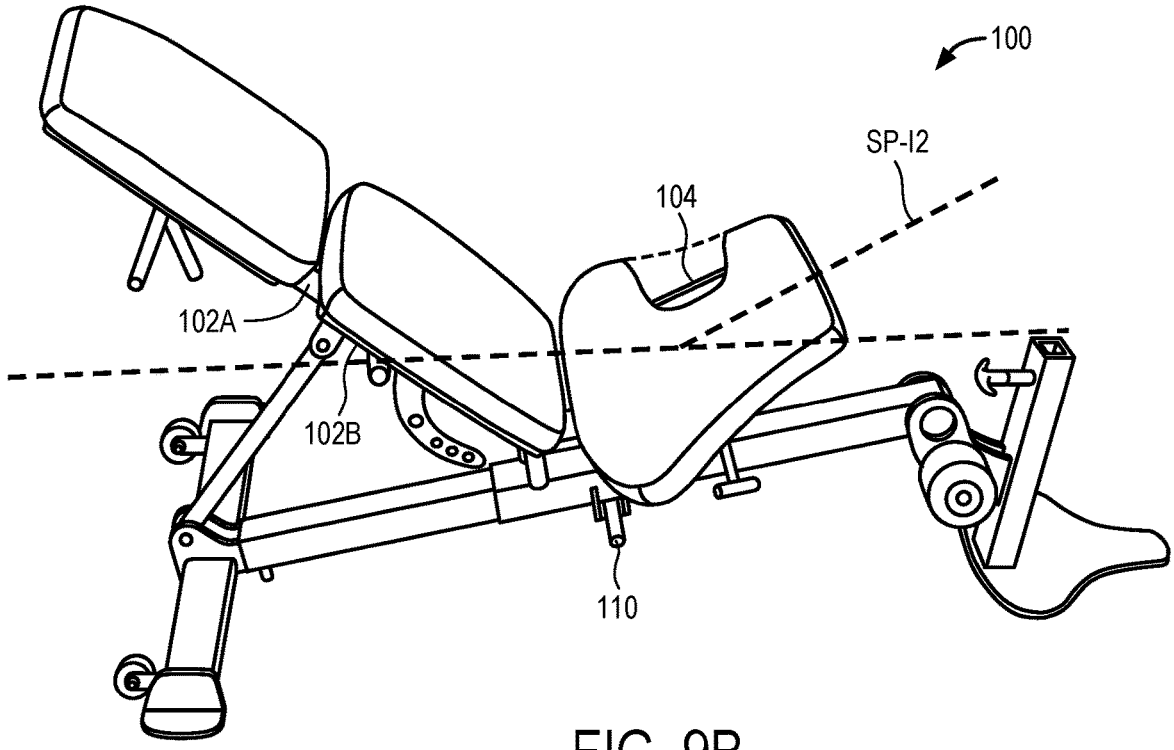

The seat support portion 104 is also adjustable between a flat or horizontal and inclined positions. Representative inclined positions that seat portion 104 may be adjusted to are illustrated in FIGS. 9A-9B. For example, FIG. 9A shows seat support portion 104 adjusted from a flat or horizontal position to a first inclined angle (SP-I1) relative to horizontal/ground and/or back support portion 102, and FIG. 9B shows seat support portion 104 adjusted to a second inclined angle (SP-I2), different from the first angle. Although a number of representative angles/positions are shown, it should be understood that seat portion 104 may be adjusted to any number of positions/angles between the horizontal position and the illustrated inclined positions/angles. For example, in some aspects, the inclined position of the seat portion 104 may be at an angle within a range of anywhere from about zero degrees (e.g., horizontal) to about 45 degrees relative to horizontal, when measured in a counter-clockwise direction.

The overall bench and/or back support portion may be adjustable between flat, decline and incline positions by sliding the seat base back and forth on the main base frame 106. An articulation link 108 is further connected to the base frame 106 and the back support portion 102. The articulation link 108 positions the seat portion 104 and back support portions 102A, 102B for flat, decline and different incline positions based on where the seat support portion 104 is positioned along the main base frame 106. For example, the articulation link 108 may be pivotally connected to back support portion 102 at one end and the base frame 106 at the other end. In this aspect, as can be seen from the drawings, the articulation link 108 adjusts between a closer to horizontal position when back support portion 102 is in a horizontal position (e.g, FIG. 1) and a more vertical position when back support portion 102 is adjusted to a closer to vertical position (e.g., FIG. 3). In addition, it can be seen that the articulation link 108 may be proximate the back support portion 102 when adjusting the carriage 112 along the base frame 106.

This sliding of the seat support portion 104 back and forth along the main base frame 106 as shown by FIGS. 6A-6D keeps the position of the bench pressing location for chest/incline/shoulder presses under the press bar position of a smith machine without moving the bench base frame 106 in relation to the floor.

Figure 2:
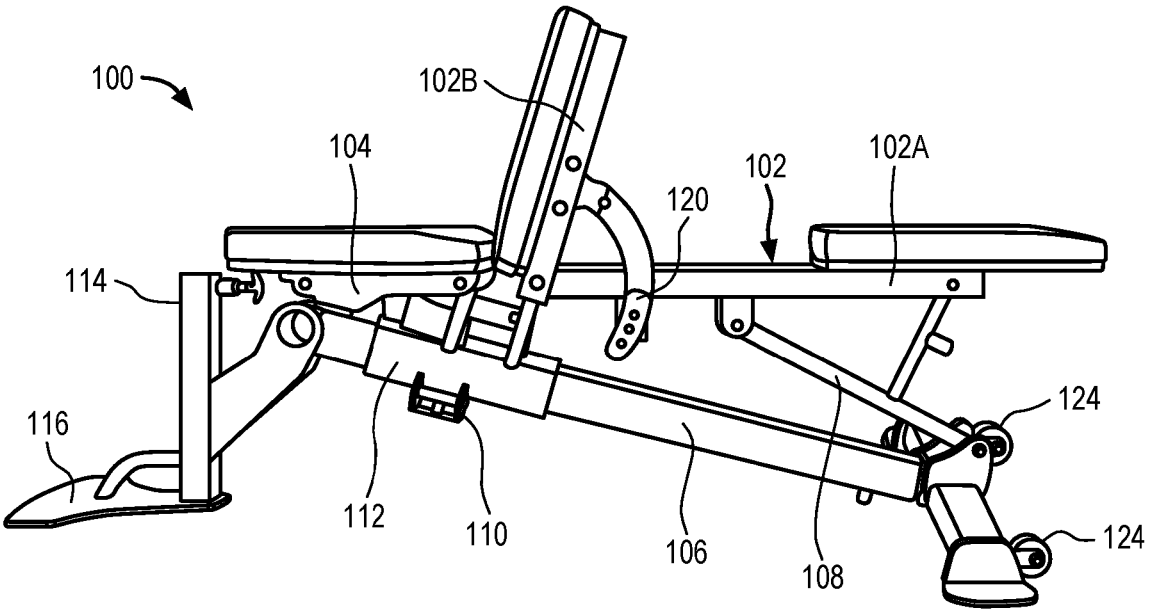
FIG. 2 illustrates a side view the adjustable back support of FIG. 1 according to another embodiment.
Figure 4:
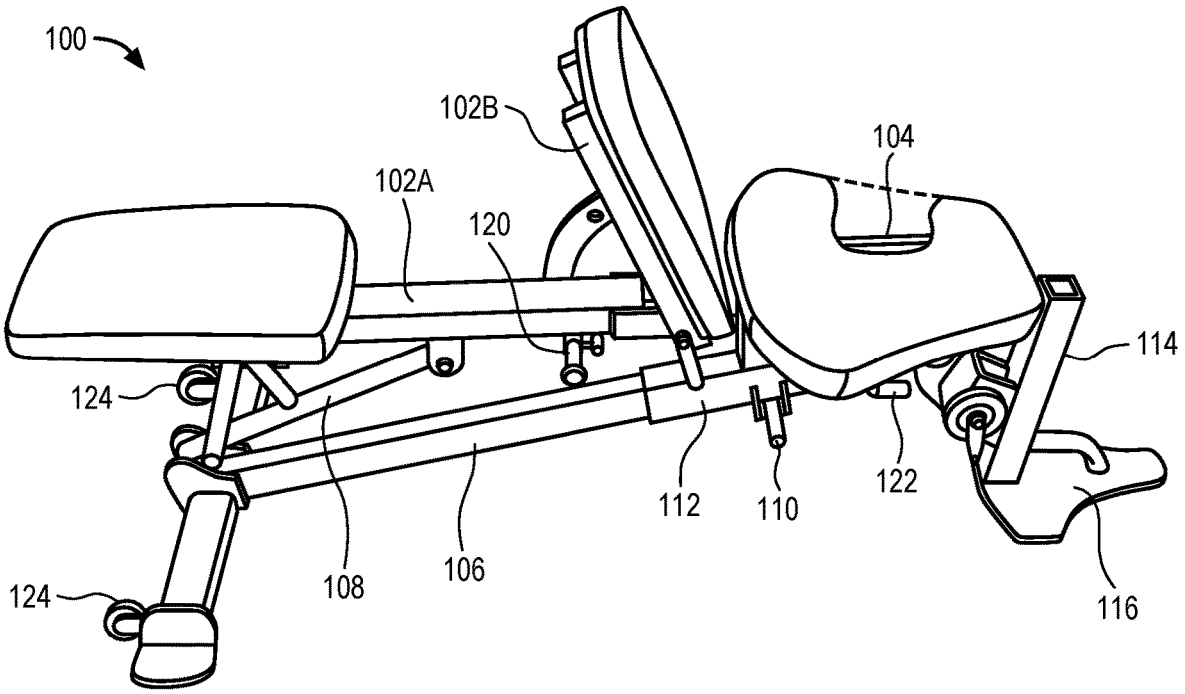
FIG. 4 illustrates a perspective side view of the adjustable back support of FIG. 1 according to another embodiment.

The adjustable bench may further include lock and release mechanisms for adjustment of the back support portion overall, the lower back support portion and/or the seat portion. Representatively, as shown in FIGS. 1-4, the bench may include a lock and release mechanism 110 for adjustment of the overall back support portion (e.g., lower and upper back support portions 102A-B). In addition, a lock and release mechanism 120 for adjustment of the lower back support portion 102B and a lock and release mechanism 122 for the seat support portion 104 may further be provided. The lock and release mechanism 110, as shown in FIG. 4, may be operated by hand or foot by pushing down on the lever/handle. The lock and release mechanisms 110 as shown in FIG. 1-3 is operated by hand or a foot of the user. Lock and release mechanism 110 may include a lever and/or handle. The lever and/or handle actuates a pin under the sliding carriage 112 that is biased towards holes along the underside of base frame 106 to lock the sliding carriage 112 in various positions along the base frame 106. Lock and release mechanisms 120 and 122 may include a pin in a cylinder or on a pivoting lever that is biased towards holes in a selector plate or frame to lock the supports 102B and 104 into various positions. Lock and release mechanisms 120 and 122 may include cylinder spring pins that can be used to adjust the lower back support reclination and/or seat reclination as desired. For example, lock and release mechanism 120 may include a bracket portion connected to the lower back support portion 102B at one end and a cylinder spring pin at another end that can be biased towards holes in the end of the bracket to adjust the reclination of the lower back support portion 102B.

The adjustable bench may further include a sliding carriage 112 coupled to the base frame 106. The sliding carriage 112 may be configured to adjust and lock to various positions along the base frame 106 and hold the back support portion 102 and seat support portion 104 to the base frame 106. In some aspects, adjustment of the carriage 112 from a front end 116 of the base frame 106 toward a back end 118 of the base frame 106 inclines/declines the back support portion 102 (including lower support portion 102A and upper support portion 102B). FIGS. 6A-6E illustrate this aspect. In particular, it can be seen from FIGS. 6A-6E that as the carriage 112 slides the seat support 104 along the frame in the direction of the arrow (e.g., toward the back end 118), the incline of the back support 102 is adjusted from the flat or horizontal position (e.g., FIG. 6A) to various incline/decline positions (e.g., FIGS. 6B-6E). As can further be seen, the angle of the incline position of back support 102 increases (e.g., gets closer to vertical) the closer the carriage 112 becomes to the back end 118. In addition, as can be seen from FIG. 6E, when the carriage 112 slides in the opposite direction (e.g., toward the front end 116), the back support 102 is adjusted to the decline position. In this aspect, the back support 102 can be adjusted to any of the positions as discussed in reference to FIG. 8A-8D. It can further be seen that during each of these adjustments, the pressing position remains constant to the floor without moving the bench.

Figure 5:
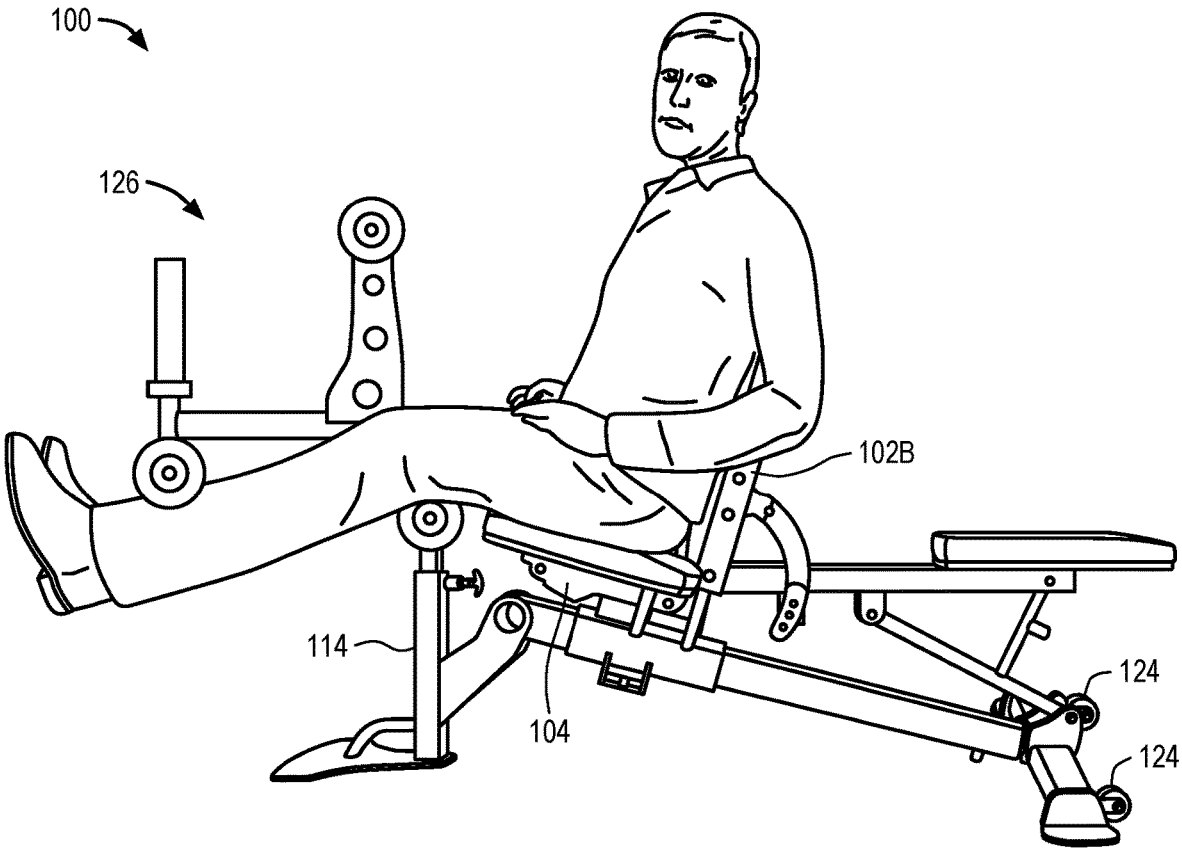
FIG. 5 illustrates a perspective side view of the adjustable back support of FIG. 1 according to another embodiment.
Figure 6A:
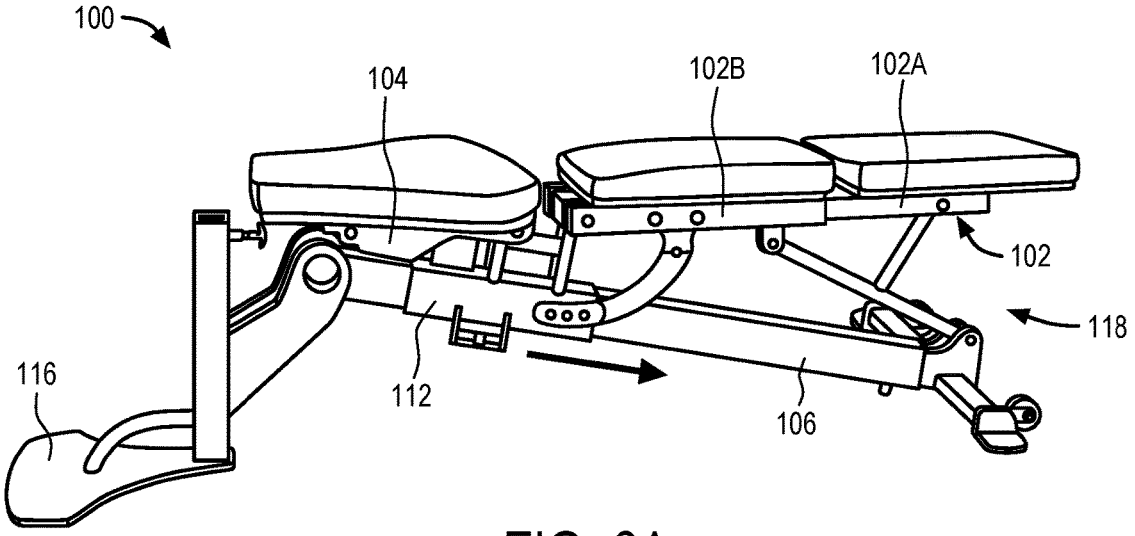
FIGS. 6A-6E illustrate side perspective views of the adjustable back support of FIG. 1 according to another embodiment.
Figure 6B:
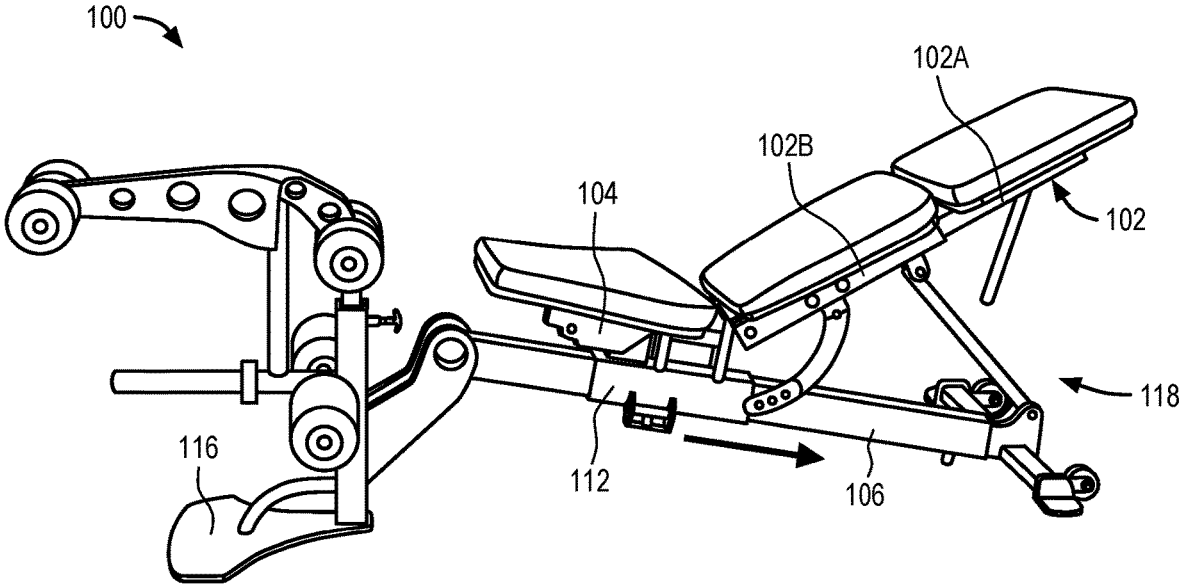
Figure 6C:
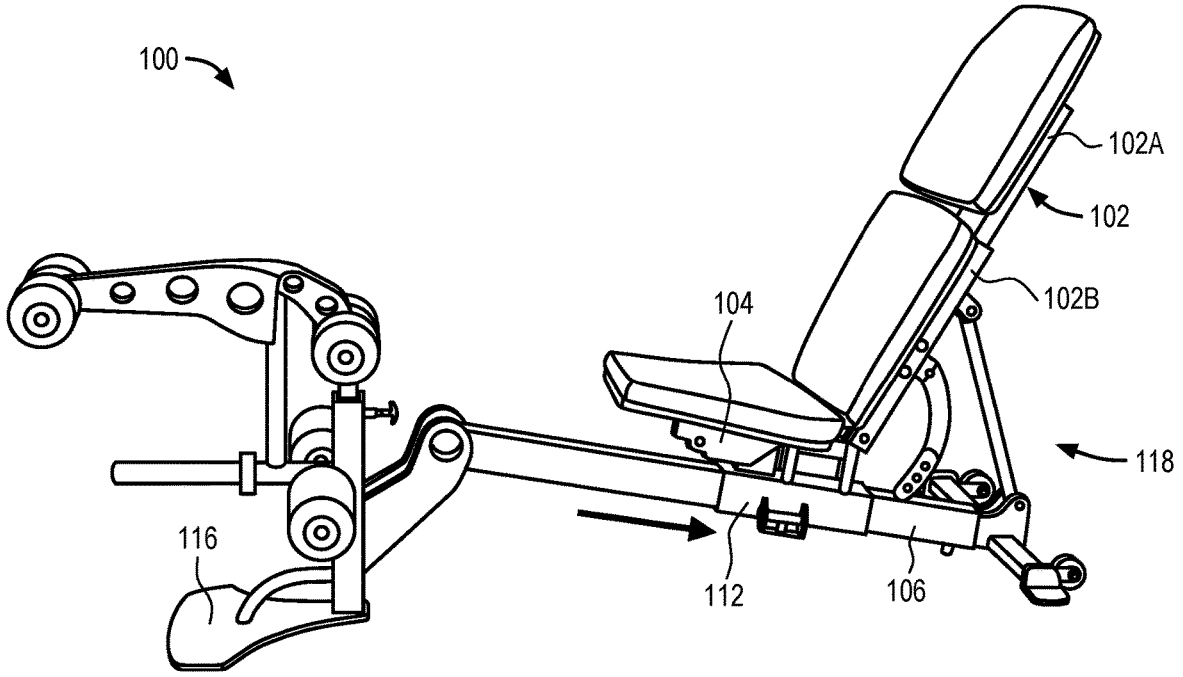
Figure 6D:
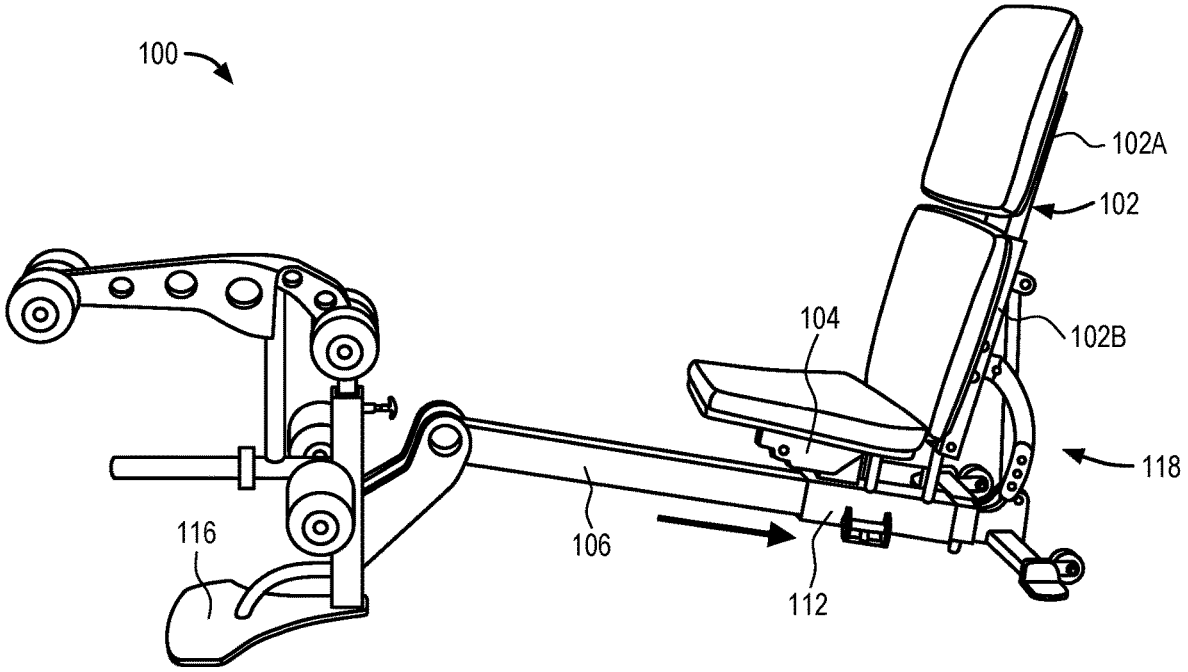
Figure 6E:
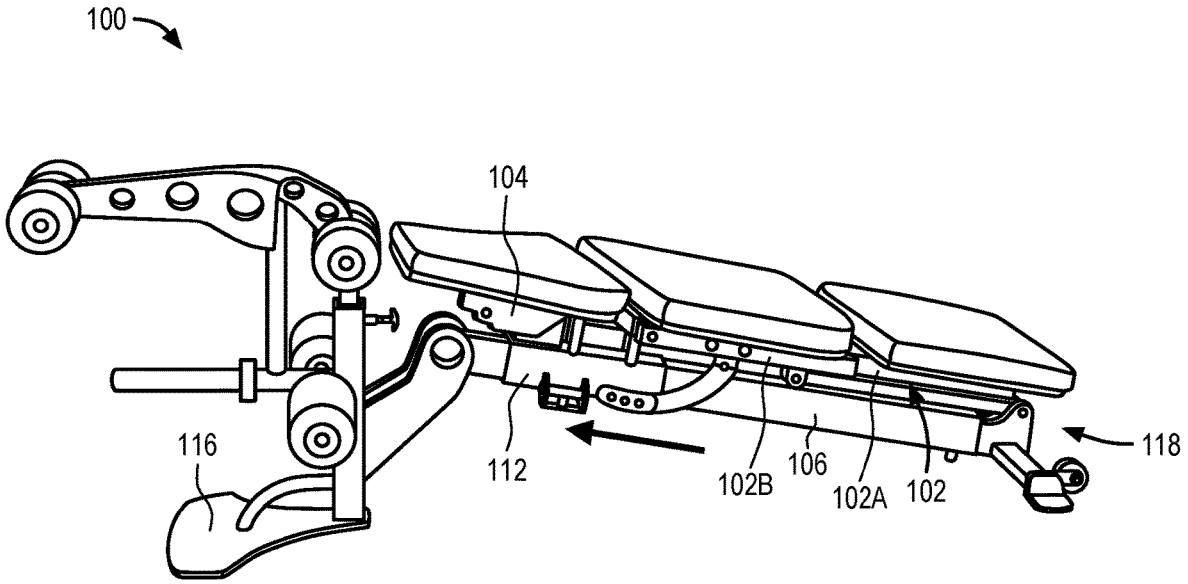

The adjustable bench may further include an optional receiver attachment 114 proximal to, or mounted to, a front end 116 of the base frame 106, as shown in FIG. 3. The receiver attachment 114 may be used to attach optional exercise stations and/or equipment to the bench. For example, the receiver attachment 114 may be a vertically extending bar having an opening for receiving an attachment portion of the exercise station or equipment. Representatively, as shown in FIG. 5, a leg extension mechanism 126 is attached to the bench by the receiver attachment 114. The user may then sit on the seat portion 104 with their lower back resting on the lower back portion 102B, and their legs positioned in the leg extension mechanism 126 as shown. The user may then lift and lower their legs to lift/lower a resistance attached to the leg extension mechanism 126.

The adjustable bench may further include wheels 124 coupled to the base frame 106 to allow the user to easily move the bench. Representatively, wheels 124 may be attached to the back end 118 of the frame as shown. In other aspects, wheels 124 may be attached to the front end 116. In still further aspects, wheels 124 may be attached to both the front and back ends 116, 118, or any other portion of the bench frame that will allow for the bench to be moved between positions along the floor.

While certain aspects have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting. In addition, to aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An adjustable exercise bench comprising:

a back support coupled to a seat support; and the back support is adjustable between a generally horizontal position and an inclined position, the back support having a first support portion and a second support portion, wherein the second support portion is adjustable together with, and separately from, the first support portion, between the generally horizontal position and the inclined position, and wherein the second support portion is a lower back support portion and the lower back support portion is dimensioned to support only a lower back of a user such that using only the lower back support portion for seated exercises provides freedom of movement of a user's shoulders by keeping the shoulders free from restriction.

2. The adjustable exercise bench of claim 1 further comprising a first support portion pad coupled to the first support portion and a second support portion pad coupled to the second support portion.

3. The adjustable exercise bench of claim 1 wherein the inclined position is a first inclined position, and the bench further comprises a second inclined position.

4. The adjustable exercise bench of claim 1 wherein the seat support is adjustable from the generally horizontal position to an inclined position.

5. The adjustable exercise bench of claim 1 further comprising:

a base frame to support the back support and the seat support.

6. The adjustable exercise bench of claim 5 further comprising:

a sliding carriage coupled to the base frame, the sliding carriage configured to adjust and lock to various positions along the base frame and hold the back support and seat support to the base frame.

7. The adjustable exercise bench of claim 6 further comprising:

an articulation link coupled between the base frame and the back support to adjust the back support between the generally horizontal position and the inclined position relative to a floor, and wherein the articulation link is proximate the back support when adjusting the sliding carriage along the base frame.

8. The adjustable exercise bench of claim 7 wherein the articulation link is pivotally secured between the base frame and the back support.

9. The adjustable exercise bench of claim 5 wherein a front end of the base frame is configured to be coupled to an exercise accessory.

10. The adjustable exercise bench of claim 6 further comprising:

a lock that is operable to lock the sliding carriage at various positions along the base frame, and the lock is operable to be activated by a hand or a foot of the user.

11. The adjustable exercise bench of claim 1 wherein the seat support is adjustable from the generally horizontal position to the inclined position.

12. An adjustable exercise bench comprising:

a base frame;

a carriage adjustable along the base frame;

a lock operable to lock the carriage at various positions along the base frame; and a back support and seat support coupled to the carriage, wherein the back support is adjustable between a generally flat position and an inclined position, and wherein the back support comprises an upper support portion and a lower support portion, and the lower support portion is operable to be adjusted together with, and separately from, the upper support portion between the generally flat position and inclined positions.

13. The adjustable exercise bench of claim 12 wherein the carriage is slidably adjustable along the base frame and locks to various positions along the base frame and holds the back support and seat support to the base frame.

14. The adjustable exercise bench of claim 13 further comprising an articulation link secured between the base frame and the back support to adjust the back support from the generally flat position to the inclined position relative to a floor, and the articulation link is proximate the back support when adjusting the carriage along the base frame.

15. The adjustable exercise bench of claim 14 wherein the articulation link is pivotally secured between the base frame and the back support.

16. The adjustable exercise bench of claim 12 wherein a front end of the base frame is configured to attach to an exercise accessory.

17. The adjustable exercise bench of claim 12 wherein the lower support portion is dimensioned to contact only a lower back of a user such that for seated exercises the lower support portion provides freedom of movement of the user's shoulders by keeping the user's shoulder blades free from restriction.

18. The adjustable exercise bench of claim 12 wherein the lock is operable to be released by a hand or a foot of a user.

19. The adjustable exercise bench of claim 12 wherein the seat support is adjustable from a declined position to an inclined position.

20. An adjustable exercise bench comprising:

a back support, a seat support and a receiver for attaching optional exercise stations, the back support comprising a lower back support and an upper back support, wherein the lower back support and the upper back support are operable to be inclined together to form an elongated back support, and the lower back support is operable to be inclined separate from the upper back support to form a shortened back support, and wherein when the lower back support is inclined separate from the upper back support, the lower back support supports the lower back of a user without supporting the user's shoulders to provide freedom of movement of the shoulders.

21. The adjustable exercise bench of claim 20 wherein the seat support is operable to adjust from a generally flat position to an inclined position.

22. The adjustable exercise bench of claim 20 wherein a base frame supports the back support, the seat support, and the receiver.

23. The adjustable exercise bench of claim 22 wherein the receiver is proximate to a front end of the base frame.

24. The adjustable exercise bench of claim 22 further comprising:

a sliding carriage that is operable to be adjusted and locked at various positions along the base frame and hold the back support and seat support to the base frame.

25. The adjustable exercise bench of claim 24 wherein adjustment of the carriage from a front end of the base frame toward a rear end of the base frame inclines the back support.

26. The adjustable exercise bench of claim 25 further comprising a locking mechanism operable to lock the carriage at various positions along the base frame, and wherein the locking mechanism is operable to be activated by a hand or a foot of a user.

* * * * *